US005881625A

United States Patent [19]

Wellman

[11] Patent Number: 5,881,625

[45] Date of Patent: Mar. 16, 1999

[54] AUTOMATIC OR PROGRAMMABLE CHANGE-OVER BALL LOCK PUNCH RETAINER APPARATUS

[75] Inventor: Charles G. Wellman, Novi, Mich.

[73] Assignee: AIP Inc., Troy, Mich.

[21] Appl. No.: 811,123

[22] Filed: Mar. 3, 1997

[51] Int. Cl.[6] ..... B26F 1/04

[52] U.S. Cl. ..... 83/563; 83/698.91; 234/114; 234/116

[58] Field of Search ..... 234/111, 114, 234/116; 83/571, 698.91, 563

[56] References Cited

U.S. PATENT DOCUMENTS

| | | | |
|---|---|---|---|
| 3,948,135 | 4/1976 | Meier, Jr. | 234/116 X |
| 4,558,616 | 12/1985 | Sakamoto | 83/399 |
| 4,569,267 | 2/1986 | Klingel | 234/111 X |
| 4,623,089 | 11/1986 | Scott | 234/114 |
| 5,038,599 | 8/1991 | Wellman | 83/698.91 X |
| 5,144,872 | 9/1992 | Kakimoto | 234/114 X |

OTHER PUBLICATIONS

Dayton Progress Corporation Catalog, Change Retainer, no date.

*Primary Examiner*—Eugenia A. Jones
*Attorney, Agent, or Firm*—Dinnin & Dunn,P.C.

[57] ABSTRACT

An automatic change-over ball lock punch retainer including a punch retainer having a punch, a retainer block, and an arm member in a sliding engagement retainer with the retainer housing block. The arm member having a camming means which interengages with an inclined surface of the punch retainer to move a punch into an active or inactive punch position.

8 Claims, 3 Drawing Sheets

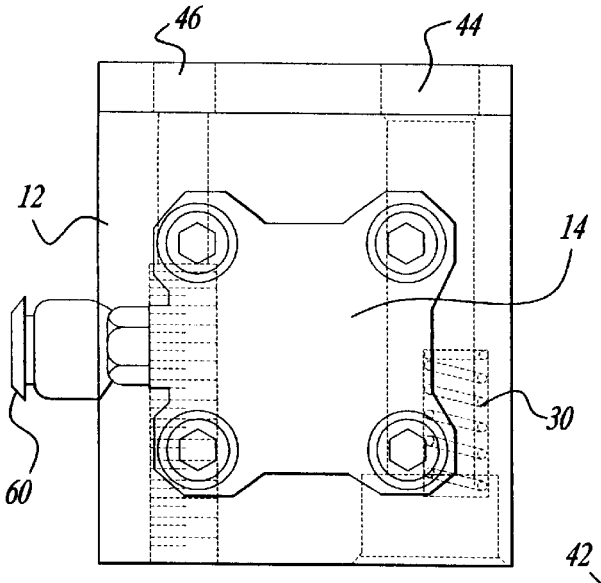
Fig-5
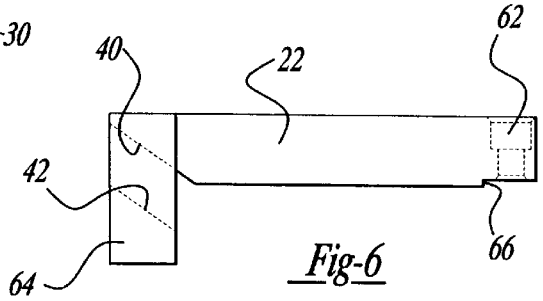
Fig-6
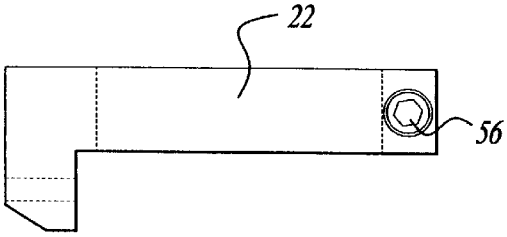
Fig-7
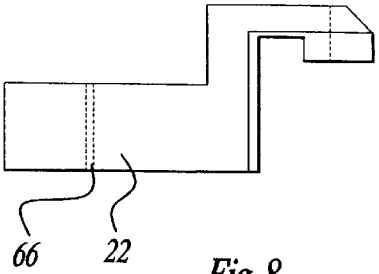
Fig-8
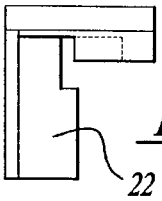
Fig-9
Fig-10
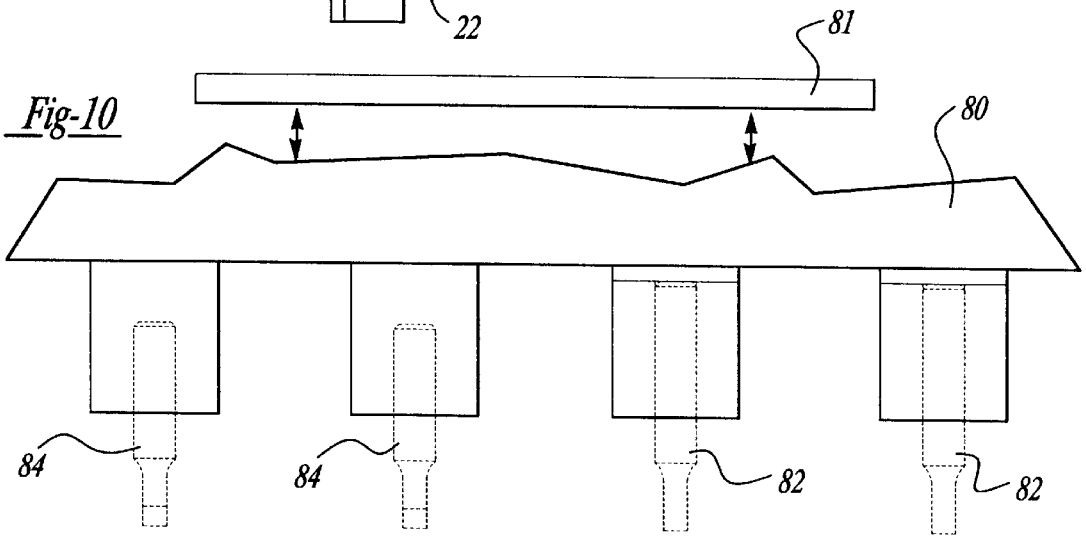

AUTOMATIC OR PROGRAMMABLE CHANGE-OVER BALL LOCK PUNCH RETAINER APPARATUS

BACKGROUND OF THE INVENTION

1. Field of the invention

The present invention relates generally to a punch retainer for use in a punch and die assembly, and more particularly to an automatic or programmable change-over ball lock punch retainer for use in a punch and die assembly.

2. Description of the Related Art

Punch retainers have been used in punch and die assemblies for many years. The punch retainers retain a punch in the die shoe while the punch is moved to form an aperture in a sheet of metal. The punch retainers are used in combination with an upper die shoe and a punch press which can hold a plurality of punches for various jobs that place apertures in a sheet of metal. A typical die shoe for multiple sheet metal parts has a plurality of punches that are not needed for each particular metal stamping process. In that case gagging retainers as known in the art have been used to place a punch in an active position for stamping of the material or to recess the punch so that punch will not form its aperture in the metal stamping process. A typical example of a die shoe having a plurality of punches includes fifteen punches that are fixed in position and form an aperture every time the stamping process is completed along with five gagging retainer punches which are liftable and capable of being deactivated into a position such that an aperture is not formed in the stamping process.

Prior art gagging retainer systems have used spring biased means to physically lift a punch away from its proper punching position or used a toggle mechanism to lower the tool holder thus making the lower punching tool inactive with respect to the work piece positioning means. However, the prior art techniques springs were not very reliable and caused down time of the stamping process and the servicing of the prior art punches required basic disassembly of the press to remove the punch and service the punch. The prior art also did not actively confirm that a punch had been placed in its retracted position.

Therefore, there is a need in the art for a punch retainer to overcome the above shortcomings.

SUMMARY OF THE INVENTION

It is an object of the present invention to provide an automatic or programmable change-over ball lock punch retainer.

It is another object of the present invention to provide a positive return ball lock punch retainer that does not use a spring for the necessary force to recess the punch.

A further object of the present invention is to provide a positive means for indicating that a punch has been retracted.

Yet another object of the present invention is to provide a change-over ball lock punch retainer that does not have to have the press disassembled to remove the punch and service the punch and/or change the punch type.

In order to achieve the foregoing objectives, an automatic or programmable change-over ball lock punch retainer according to the present invention is provided. The gagging punch retainer includes a retainer housing block, a ball-lock retainer with a hardened backing plate, a housing cover plate, an arm member connected to a pneumatic air cylinder, the arm member including a first camming surface and a second camming surface which interengages with a first incline surface and a second incline surface on a punch retainer which is placed within a passage of the retainer housing block.

One advantage of the present invention is that it has a positive return that does not require a spring to recess the punch.

A further advantage of the present invention is that it has a positive indicator showing when the punch has been retracted.

A further advantage of the present invention is that the press does not have to be disassembled to remove the punch.

Other objects, features and advantages of the present invention will become apparent from the subsequent description and appended claims, taken in conjunction with the accompanying drawings.

BRIEF DESCRIPTION OF THE DRAWINGS

FIG. 2(*a*) shows a side view of the ball lock punch retainer in the non-active up position.

FIG. 5 shows an end view of the ball lock punch retainer from the cylinder.

FIG. 6 shows a side view of the arm member.

FIG. 7 shows a top view of the arm member.

FIG. 8 shows an angled end view of the arm member.

FIG. 9 shows an end view of the arm member.

FIG 10 shows a die shoe with a combination of gagging retainers and normal punch retainers.

BEST MODE OF CARRYING OUT THE INVENTION AND DESCRIPTION OF THE PREFERRED EMBODIMENT(S)

Figure 1:
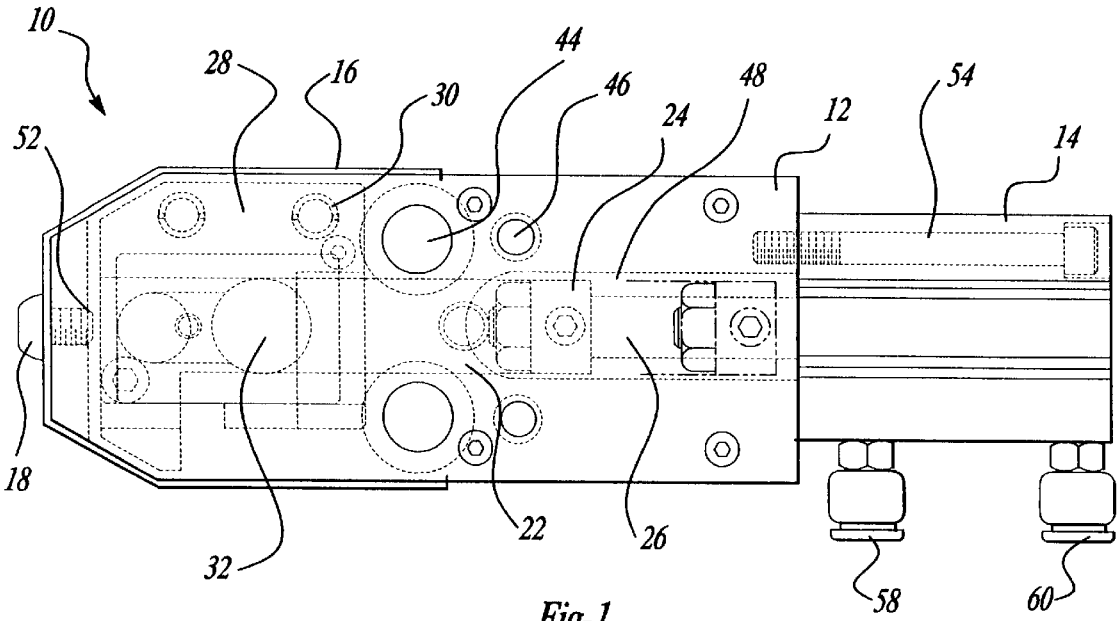
FIG. 1 shows an overhead view of the ball lock punch retainer.

Referring to FIG. 1 there is shown an automatic or programmable change-over ball lock punch retainer or gagging punch retainer 10, according to the present invention. A typical layout for a punch and die press includes an upper die shoe 80 that has approximately fifteen permanently fixed punches 82 which punch every time a metal stamping process occurs. Along with those approximately fifteen permanent punches 82 are approximately five punches 84 using gagging retainers 10 which allow for the punch 84 within the gagging retainer 10 to be recessed or moved into a non active punching position thus not creating an aperture into a piece of metal during a stamping operation. FIG. 10 shows a partial cross section of an upper die shoe 80 that includes two permanent punches 80 and two gagging punches 84 according to the present invention. In operation the punch is forcibly punched through a metal sheet into the lower die shoe (not shown) thus making an aperture within the metal or sheet metal being punched.

The automatic or programmable change-over ball lock punch retainer 10 includes a retainer housing block 12 which is connected to the upper die shoe 80 and allows for movement and a recessing of the punch 84 according to the operators inputs. The retainer housing block 12 includes a plurality of orifices (44, 46) for connecting the retainer housing block 12 to the die shoe 80. The orifices (44, 46) are preferable circular in cross section but may be any other shape or size necessary depending on the specific application. The retainer housing block 12 also includes a first passageway 48 which allows an arm member 22 to slide within the passageway 48 in a horizontal motion. The retainer housing block 12 further includes a second passageway 50 which is used to hold a punch retainer 28 and allow for a vertical movement of the punch retainer 28 through the passageway 50 and thus the retainer housing block 12. The retainer housing block 12 on one end also includes an orifice 52 for securing a protective cover 16 to the end of the retainer block 12 nearest the punch retainer 28 thus providing safety and keeping dust and foreign materials from contaminating the punch retainer 28. The protective cover 16 is generally U-shaped in cross section and is fastened to the retainer block 12 by a metal screw 18 or other appropriate fastener.

Connected to an end of the retainer housing block 12 opposite the dust cover 16 is a cylinder 14 which is preferably a double acting pneumatic cylinder, but it must be appreciated that any type of fluid, electrically controlled, or other mechanically controlled cylinder such as a screw mechanism, etc. may be used depending on the application necessary. The double acting cylinder 14 is connected to the end of the retainer housing block 12 via two or four screws 54 or any other capable fasteners. The double acting cylinder 14 includes an air controlled projection 26 that slides within the first passageway 48 of the retainer housing block 12. The sliding projection 26 is connected to the bracket 24 via a screw 56 or other appropriate fastener to an arm member 22. The arm member 22 is also held in the passageway 48 and is capable of sliding the entire length of the passageway 48. The arm member 22 slides back and forth through the passageway 48 depending on the motion of the projection 26 of the air cylinder 14 and thus is control by a pneumatic system connected to the air cylinder 14, via connectors 58, 60.

The arm member 22 as shown in FIGS. 6 through 9 generally has an L-shaped appearance from its top view, end view and its side view. On one end of the arm member 22 is an aperture 62 which is used to connect the arm member 22 to bracket 24 to the projection 26 of air cylinder 14 via a screw 56 or other appropriate fastener. The arm member 22 has a flat upper surface. The arm member 22 incudes a first camming surface 42 and a second camming surface 40 for use in moving the punch retainer 28, it should be noted that other cams and camming mechanisms may be used such as toggles, gears or any other type appropriate for this application. The first camming surface 42 is located on a downward projecting projection 64. The first camming surface 42 has a predetermined angle, the angle can be any appropriate angle necessary depending on the application being used. The first camming surface 42 is used to move the punch retainer 28 into a non active, non punching position. The arm member 22 also includes a second camming surface 40 which is on the bottom surface of the arm member 22. This second camming surface 40 is used to move the punch retainer 28 into is active, punching position. The arm member 22 also includes an abutting surface 66 on its bottom surface opposite the second camming surface 40 such that the projection 26 from the cylinder 14 is properly placed in relation to the arm member 22.

A punch retainer 28 is place vertically within the second passageway 50 of the retainer housing block 12. The punch retainer 28 includes a ball-lock retainer body 68 with an integrally connected back plate 64. The punch retainer 28 is similar to the one patented in my U.S. Pat. No. 5,038,599. The punch retainer 28 includes a spring 72 and ball 74 which interconnects with the punch 32 through the punch retainer 28. The punch 32 is held within the passageway by the spring 72 pushing the ball 74 into a locking position on the punch 32. The punch retainer 28 is moveable within the second passageway 50 in a vertical, up and down motion. The punch retainer 28 is capable of two positions within the retainer block 12. The first is the up or inactive position, see FIG. 2(*a*), and the second is the down or active punching position, see FIG. 2. The punch retainer 28 also includes on one side a projection member 86. The punch retainer 28 also includes a first incline surface 38 and a second incline surface 36.

The punch retainer 28 also includes two small circular orifices which are to hold a spring 30. The retainer housing block 12 also includes two circular orifices opposite the orifices of the punch retainer 28 for use in holding the spring member 30. The spring member 30 would be used to eliminate vibration drift of arm member 22 in the active position should the pneumatic air cylinder 14 lose air supply and also would be used to apply an urging force to the punch retainer 28 which would move the punch retainer 28 into its inactive or up position. However, it should be noted that the spring member 30 is not necessary for the punch retainer 28 to be moveable and capable of moving into its first and second positions. The gagging retainer 10 is a positive return member and thus does not need a spring to positively return the punch retainer 28 into its appropriate positions.

A backing cover 34 is connected to the top surface of the retainer block 12 to create a flat uniform surface between the top surface of the retainer block 12 and the top surface of the arm member 22 which slides within the passageway 48 of the retainer block 12. The backing cover plate 34 also serves as a stop for the punch retainer by not allowing the arm member 22 to flex in the vertical direction when pressure from the top surface of the punch retainer 28 is transferred during a stamping operation.

The automatic or programmable change-over ball lock punch retainer 10 also includes an indicator or other system capable of positively identifying that the punch is in its retracted position. It might be that a light is used to indicate that the punch is in its positive punch position or that it is in its inactive up position.

Figure 2:
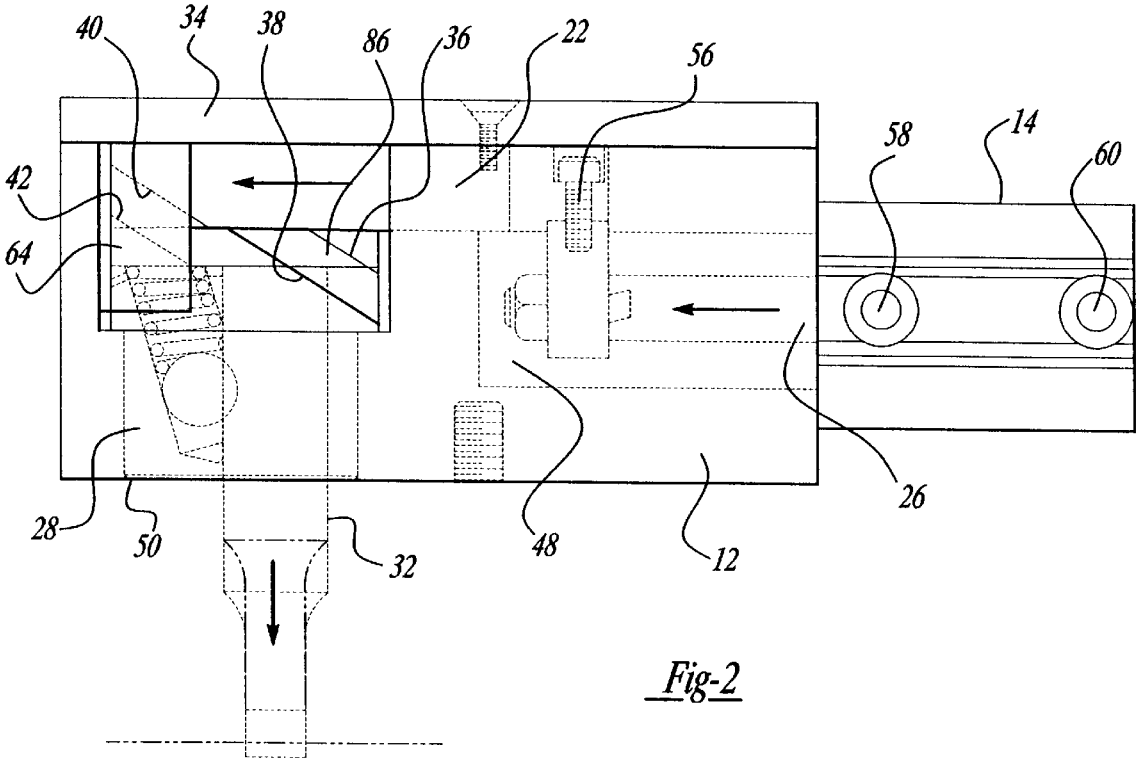
FIG. 2 shows a side view of the ball lock punch retainer according to the present invention in the active punching position.
Figure 2A:
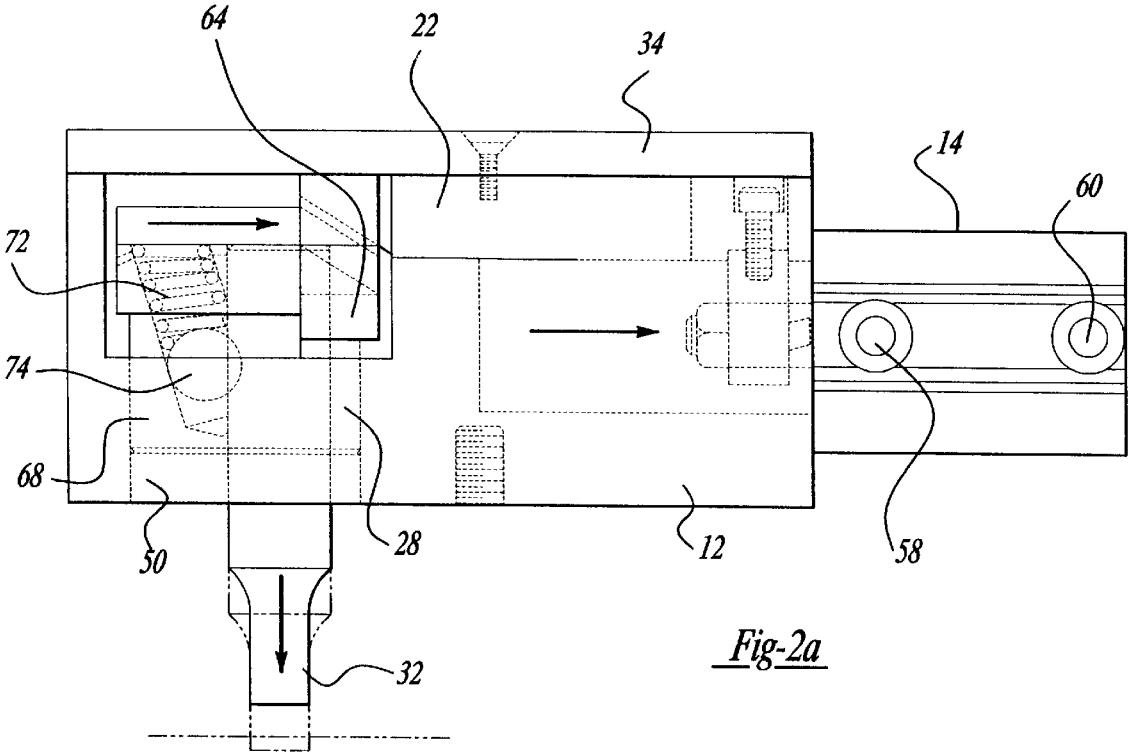
Figure 3:
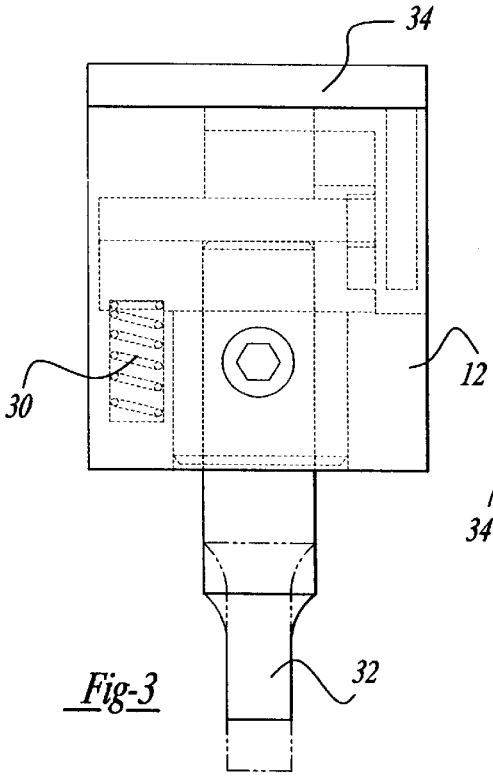
FIG. 3 shows an end view of the ball lock punch retainer in the down or active position.
Figure 4:
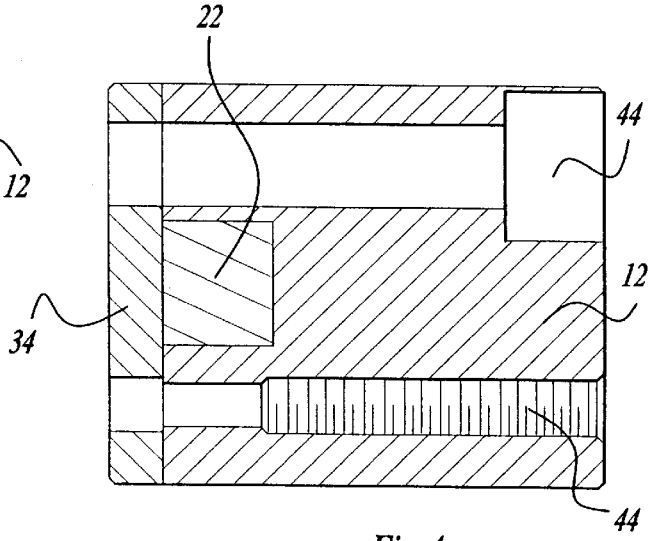
FIG. 4 shows a cross section of the retainer block from an end.

In operation, the first camming surface 42 of the arm member 22 comes into contact with the first incline surface 38 of the punch retainer 28 and the surfaces 38, 42 interengage with one another and forcibly move the punch retainer 28 in a upward direction thus putting the punch in an inactive punching position, see FIG. 2(*a*). The preferred movement of the punch 32 is approximately five sixteenths of an inch (eight millimeters) but can be anywhere up to one inch of movement upward away from the metal being punched. The punch retainer 28 is moved via the interengaging of the first camming surface 42 and the first incline surface 38 of the punch retainer 28 until the projection 26 has completely retracted itself into the pneumatic cylinder 14. When the operator would like to once again engage the punch 32 to be active during the stamping process he will program the pneumatic cylinder to slide its projection 26 out of its chamber. The sliding motion of the arm member 22 away from the pneumatic cylinder 14 will in turn have the second camming surface 40 of the arm member 22 engage with the second incline surface 36 of the punch retainer 28. This interengagement will force the punch retainer 28 in a downward vertical motion until the punch retainer 28 has been reset into its engaged punch position. This will then lock the punch 32 in place for the next stamping operation. Therefore, the operator is capable of having the punch active for a stamping operation or to deactivate the punch for another stamping operation depending on the needs of the sheet metal being stamped.

This new ball lock gagging punch retainer allows for a positive return of the punch retainer 28 without the use of spring biasing, in the past the springs have not been reliable as the means for biasing the punch retainer 28. It also allows for the quick service of the punches because the press will not have to be disassembled in order to service or fix a problem with the punch itself. To remove the punch a tool must be inserted in the punch retainer which releases the ball lock mechanism thus removing the punch without disassembling the entire unit from the punch press.

In another aspect, the invention comprises a method of manufacturing a stamped metal product having a plurality of apertures therein, said method comprising the steps: (a) of providing a stamping machine 81 (shown schematically in FIG. 10 to move the die shoe 80 up and down for a controlled punching operation) having die shoe and at least two punch retainers therein each of which is adapted to retain and hold a punch tool therein, at least one of said punch retainers being a change-over ball lock punch retainer, including a punch retainer having a punch, said punch held in a punch retainer passage that includes a ball lock and spring assembly for holding said punch and said punch retainer; a retainer housing block having a passage for slidably holding an arm member, said retainer block having a second passage for holding said punch retainer, said arm member having a cam means, said arm member being connected to a pneumatic cylinder for slidably moving said arm member within said passage; said punch retainer having an inclined surface means which interengages with said cam means to move said punch to an active or inactive punch position, (b) moving said die shoe in a direction to form and create said apertures in said metal product, (c) removing the stamped metal product from the stamping machine.

The present invention has been described in an illustrative manner, it is to be understood that the terminology which has been used is intended to be in the nature of words of description rather than limitation. Many modifications and variations of the present invention are possible in light of the above teachings.

Therefore, within the scope of the appended claims, the present invention may be practiced otherwise then as specifically described.

What is claimed is:

1. A change-over ball lock punch retainer, including:

a punch retainer having a punch, said punch retainer including a ball lock mechanism within said punch retainer for holding said punch;

a retainer housing block having a passage formed therein for holding said punch retainer;

a cylinder connected to said retainer block;

an arm member connected to a bracket, said bracket connected to said cylinder, said arm member located within a passageway of said retainer housing block, said arm member slidably movable within said passageway of said retainer housing block, said arm member having a first camming surface and a second camming surface;

said punch retainer having a first incline surface and a second incline surface which are slidably engagable with said first camming surface and said second camming surface of said arm member respectively.

2. The change-over ball lock punch retainer of claim 1 wherein said arm member slides in a first direction in said passageway and said first camming surface interengages with said first incline surface and moves said punch into an inactive position.

3. The change-over ball lock punch retainer of claim 2 wherein said arm member slides in a second direction in said passageway and said second camming surface interengages with said second incline surface and moves said punch into an active punch position.

4. The change-over ball lock punch retainer of claim 3 wherein said second direction is opposite said first direction.

5. The change-over ball lock punch retainer of claim 1 further including a spring in contact with said retainer housing block and said punch retainer.

6. A change-over ball lock punch retainer, including:

a retainer housing block having a first passageway located on a top surface, said first passageway receiving an arm member, said retainer block having a second passageway, said second passageway receiving a punch retainer;

a cover plate connected to a top of said retainer block, a backing plate in contact with said arm member;

a cylinder connected to one end of said retainer block and connected to said arm member;

a protective cover connected to an end of said retainer housing block;

said punch retainer including a ball lock mechanism, said ball lock mechanism securing a punch within said punch retainer, said punch retainer placed within said second passageway of said retainer block;

said arm member including a first camming surface, said punch retainer having a first inclined surface, said arm member sliding within said first passageway, said arm member having a second camming surface, said first camming surface interengaging with said first inclined surface to move said punch retainer.

7. The change-over ball lock punch retainer of claim 6 further including a second inclined surface on said punch retainer.

8. The change-over ball lock punch retainer of claim 7 wherein said second camming surface interengages with said second inclined surface to move said punch retainer into an active punch position.

* * * * *